US009475058B2

(12) United States Patent
Town

(10) Patent No.: US 9,475,058 B2
(45) Date of Patent: Oct. 25, 2016

(54) LINER COMPONENT FOR A GRINDING MILL

(75) Inventor: Stuart Town, Artarmon (AU)

(73) Assignee: Weir Minerals Australia Ltd. (AU)

( * ) Notice: Subject to any disclaimer, the term of this patent is extended or adjusted under 35 U.S.C. 154(b) by 202 days.

(21) Appl. No.: 12/737,734

(22) PCT Filed: Aug. 11, 2009

(86) PCT No.: PCT/AU2009/001035

§ 371 (c)(1),
(2), (4) Date: Apr. 21, 2011

(87) PCT Pub. No.: WO2010/017589

PCT Pub. Date: Feb. 18, 2010

(65) Prior Publication Data

US 2011/0186670 A1 Aug. 4, 2011

(30) Foreign Application Priority Data

Aug. 11, 2008 (AU) ..... 2008904094

(51) Int. Cl.
*B02C 17/22* (2006.01)

(52) U.S. Cl.
CPC ..... *B02C 17/22* (2013.01); *B02C 17/225* (2013.01)

(58) Field of Classification Search
CPC ..... B02C 17/22; B02C 17/225
USPC ..... 241/182, 183, 299, 300
See application file for complete search history.

(56) References Cited

U.S. PATENT DOCUMENTS

| | | | | |
|---|---|---|---|---|
| 2,611,546 | A | 9/1952 | Posselt | |
| 3,462,090 | A | 8/1969 | Landes et al. | |
| 3,607,606 | A * | 9/1971 | Beninga | 428/67 |
| 3,883,080 | A | 5/1975 | Andersson | |
| 4,609,158 | A * | 9/1986 | Wilson | 241/300 |
| 4,848,681 | A * | 7/1989 | Eriksson et al. | 241/183 |
| 4,946,110 | A * | 8/1990 | Harris et al. | 241/282 |
| 5,431,351 | A * | 7/1995 | Lejonklou | 241/183 |
| 5,472,148 | A * | 12/1995 | Schaeffer | 241/183 |
| 5,950,944 | A * | 9/1999 | Larsen | 241/183 |
| 6,036,127 | A * | 3/2000 | Moller | 241/183 |
| 7,887,000 | B2 * | 2/2011 | Siitonen et al. | 241/183 |
| 8,235,318 | B2 * | 8/2012 | Timm et al. | 241/183 |
| 2008/0265074 | A1 * | 10/2008 | Melo et al. | 241/299 |
| 2010/0025512 | A1 * | 2/2010 | Liimatainen et al. | 241/300 |
| 2011/0220752 | A1 * | 9/2011 | Cox et al. | 241/172 |
| 2013/0299617 | A1 * | 11/2013 | Watt et al. | 241/183 |
| 2014/0331466 | A1 * | 11/2014 | Cox et al. | 29/402.14 |

FOREIGN PATENT DOCUMENTS

| | | | |
|---|---|---|---|
| RU | 2016658 | C1 | 7/1994 |
| RU | 2060053 | C1 | 5/1996 |
| RU | 2153936 | C2 | 8/2000 |
| RU | 2197326 | C2 | 1/2003 |
| WO | WO 2007048874 | A1 * | 5/2007 |

OTHER PUBLICATIONS

Mittal Steel USA, Guideline for Fabricating and Processing Plate Steel, Mar. 2006, p. 61 of 101.*
Bissalloy Steels, BISPLATE Technical Manual, Sep. 2006, Rev. 2, p. 15 of 90.*

* cited by examiner

*Primary Examiner* — Mark Rosenbaum
(74) *Attorney, Agent, or Firm* — Morriss O'Bryant Compagni

(57) ABSTRACT

A method of fabricating a liner component for a grinding mill is described, the method including the steps of: providing a plate of hard material; cutting the plate to form a plurality of inserts, at least some of the inserts including a formation for mechanically engaging with a body of a resilient material; arranging the inserts in a mould, and—adding resilient material to the mould to form a resilient material body around the inserts to thereby form the liner component.

15 Claims, 2 Drawing Sheets

LINER COMPONENT FOR A GRINDING MILL

TECHNICAL FIELD

The present invention relates generally to crushing, grinding, or comminution methods for processing materials such as mineral ores, rock and other materials, and more particularly to the fabrication of apparatus for use in such processing.

BACKGROUND ART

Grinding mills are one form of apparatus used for processing materials as described above. Typically grinding mills generally comprise a drum shaped shell mounted for rotation about its central axis. The axis of the shell is generally horizontally disposed or slightly inclined towards one end. The interior of the shell forms a treatment chamber into which the material to be processed is fed.

In one form of milling known as SAG (semi autogenous grinding), a grinding medium such as balls or rods is fed to the treatment chamber with the material to be processed and the shell rotates. During rotation of the shell the grinding medium acts on the material to cause the crushing or grinding action. The grinding medium and material to be processed are carried up the side of the shell as a result of the rotation of the shell whereafter it falls towards the bottom of the shell under the influence of gravity.

The inside surfaces of the mill are typically protected by an arrangement of wear components collectively referred to as a mill liner. The mill liner usually includes lifter bars spaced around the inner circumference of the mill. The lifter bars assist in lifting the charge inside the mill up the side of the shell as the shell rotates. Further, the mill liner often includes wear plates which are provided in between each lifter bar. The lifter bars or wear plates may be formed as a resilient body, with a number of wear resistant inserts embedded in the resilient material. The inserts are produced by casting of molten metals in a mould.

Over time, the components of the mill liner wear away and require replacement. This necessitates that the mill be stopped for a period of time which causes the cessation of the grinding of material, and may also necessitate the shutting down of other machinery in a plant which works on the material produced by the mill. There is a continued need to provide mill liner components with improved longer service lives to reduce the mill stoppage time.

SUMMARY OF THE DISCLOSURE

In a first aspect there is provided a method of fabricating a liner component for a grinding mill, the method including the steps of:

- providing a plate of hard material;
- cutting the plate to form a plurality of inserts, at least some of the inserts including a formation for mechanically engaging with a body of a resilient material;
- arranging the inserts in a mould, and
- adding resilient material to the mould to form a resilient material body around the inserts to thereby form the liner component.

Formation of the inserts by cutting them from a plate makes it possible to prepare inserts with a finer microstructure when compared to the more coarse microstructures found in metal components that have been formed by casting. A fine microstructure may be found in metal plates that have been subjected to a rolling process during their formation. An insert with a fine microstructure has improved toughness properties when compared with an insert with a coarser microstructure, which leads to increased impact resistance. This leads to increased service life of the mill liner components, and reduced mill downtime for replacing worn liners. Thus, the economic performance of the mill, and associated minerals processing operations, is improved.

In one embodiment, the method can further includes the step of applying heat and pressure to the contents of the mould to cure the resilient material to thereby form the body.

In one embodiment, the method step of cutting the plate can include any of laser, plasma or oxy cutting.

In one embodiment, the plate can be formed from steel.

In one embodiment, the formation can include a hooked portion.

In a second aspect there is provided a liner component for a grinding mill formed by the method of the first aspect.

In one embodiment of the liner component, the inserts can be distributed along the length of the component at a regular pitch.

In one embodiment of the liner component, the pitch can be less than 120 mm.

In one embodiment of the liner component, the inserts can be of a thickness in the range of 10 mm to 100 mm.

In one embodiment of the liner component, the inserts can be of a thickness of about 65 mm.

In one embodiment of the liner component, the resilient material can include an elastomeric material.

In a third aspect there is provided a liner component for a grinding mill, the component including:

- a generally elongate body;
- a plurality of inserts associated with the body, the inserts being distributed along the length of the body; and
- at least some of the inserts including a formation which engages mechanically with the body;

wherein the inserts have a measured Charpy v-notch test toughness of more than 10 J.

Mill liner components including hardened inserts with Charpy v-notch test values of 10 J or higher have significantly improved toughness properties to mill liner components which include inserts formed by casting, which may have a Charpy v-notch test value of around 2-3 J. This can provide significant improvements in the impact resistance of the mill liner, with a consequential increased service life leading to reduced mill downtime.

In one embodiment of the liner component, the inserts can have a measured Charpy v-notch test toughness of between 10 J and 45 J.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 2:
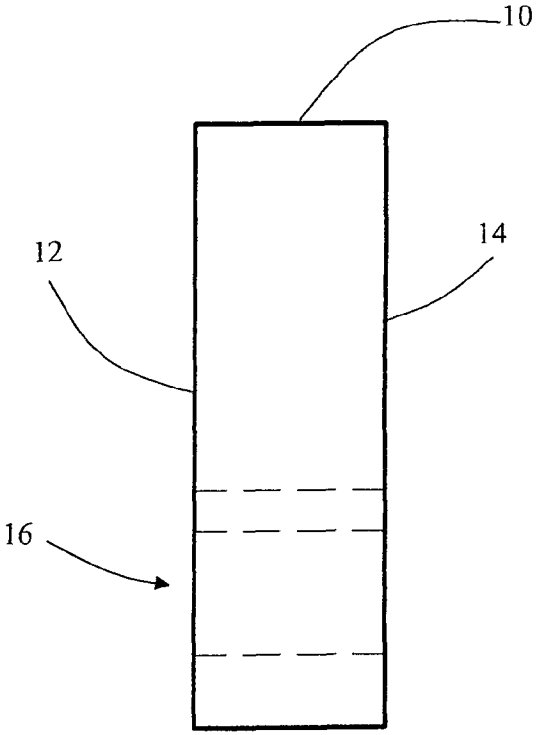
FIG. 2 is a front view of the insert of FIG. 1.
Figure 1:
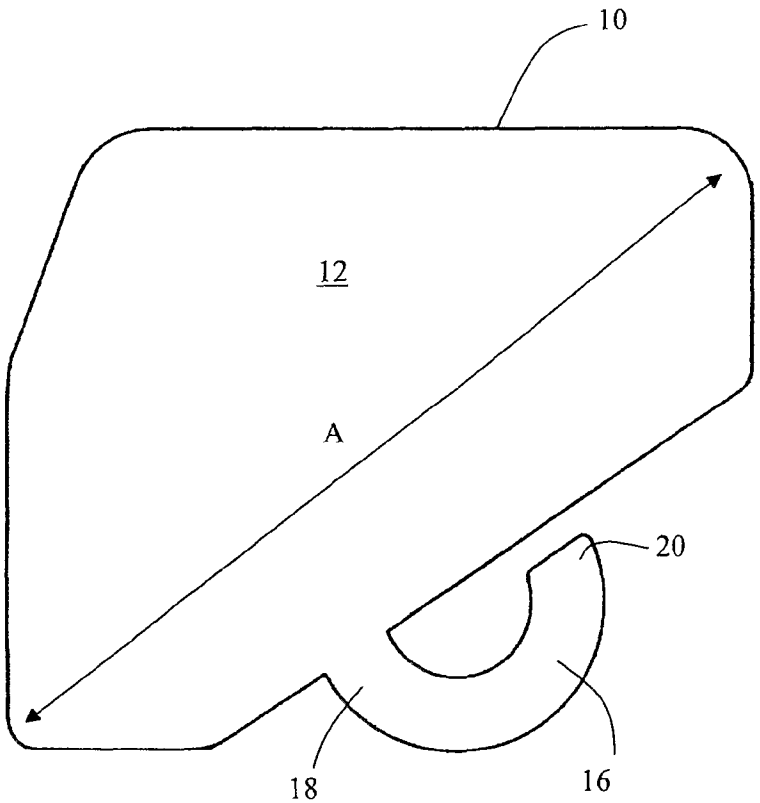
FIG. 1 is a side view of an insert for a component of a mill liner according to an embodiment of the invention.

Referring to FIGS. 1 and 2, an insert 10 for a mill liner of a grinding mill is shown. The insert 10 has a major dimension generally indicated by arrow A and opposed major surfaces being planar side faces 12, 14. Between the planes of these side faces 12, 14 there is provided a formation for mechanically engaging with adjacent resilient material. The formation includes a hooked portion 16 which has a free end 20 and which is joined to the remainder of the insert by way of a shank portion 18.

The insert 10 is formed by cutting the shape of the outline of the major faces 12, 14, including the hooked portion 16 and shank 18 as shown in FIG. 1, from a plate of hardened steel. For example, such steel plate can be manufactured from Bisalloy® 450 which is available from Bisalloy Steels Pty Ltd, of Unanderra, New South Wales, Australia (www-.bissalloy.com.au). The plate is cut by various available techniques, including laser, plasma or oxy cutting techniques. Other equivalent cutting techniques are also possible alternatives. It can be seen from FIG. 1 that the outline of the insert 10 is a continuous outline with no closed sections, such as through-holes. This allows the laser cutting operation to be carried out with a continuous single cut, with no need to stop and start the laser or any need to reposition the workpiece between cutting operations. In the illustrated embodiment, the insert 10 has been cut from a plate of Bisalloy® that was 65 mm thick. Hence, the insert has a thickness of 65 mm between its major surfaces 12, 14. Many other thicknesses of steel plate are possible.

The hardened steel used for forming the inserts has a Charpy v-notch test hardness value of between 10 to 45 J at a test temperature of −40 C. In contrast, prior art inserts that are produced by casting of metal have a Charpy v-notch test toughness value of around 2 J. A higher toughness provides for an increased resistance to impact wear.

Figure 3:
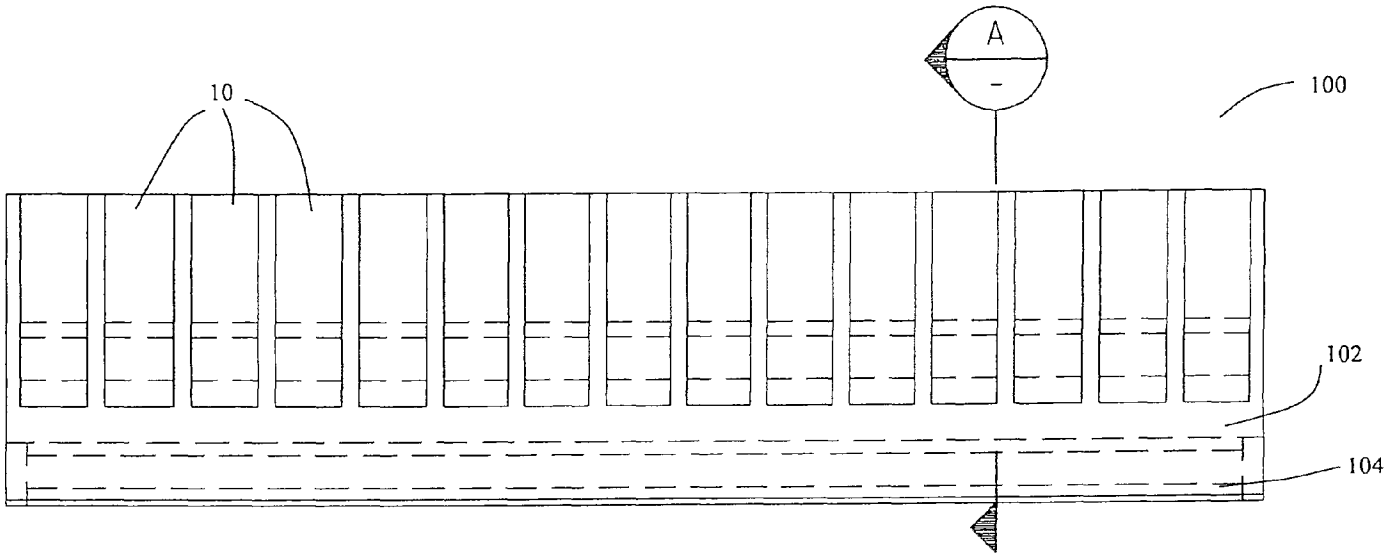
FIG. 3 is a front view of a lifter bar according to an embodiment of the invention.
Figure 5:
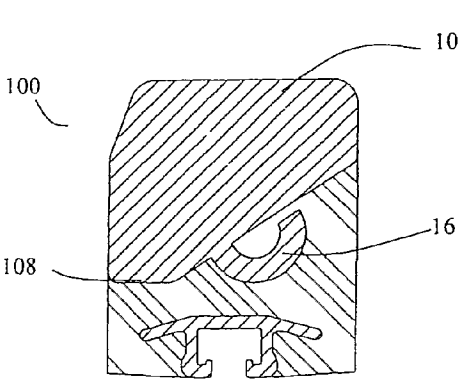
FIG. 5 is a cross sectional view along the line A of FIG. 3.
Figure 4:
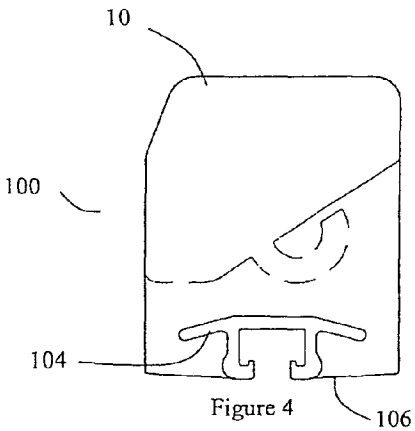
FIG. 4 is an end view of the lifter bar of FIG. 3.

The insert 10 and its method of formation finds use in the fabrication of components for a mill liner as will now be described. Referring to FIGS. 3 to 5, a component for a mill liner is shown in the form of a lifter bar 100. The lifter bar includes a body 102 formed from an elastomeric material and a total of fifteen inserts 10 which are evenly distributed along the length of lifter bar 100 and which are associated with the lifter bar by being embedded into the elastomeric body 102 to create a composite structure. The inserts are distributed along the length of the lifter bar at a pitch of about 82 mm, with each insert being 65 mm thick and each being spaced from an adjacent insert by about a 17 mm thickness of elastomeric material.

A channel 104 is embedded in the body 102 and is used to affix the assembled lifter bar 100 to the inside of the shell of a grinding mill using T-headed bolts in a known fashion. Thus, when installed, mounting surface 106 faces against the inside surface of the shell of the grinding mill.

The lifter bar 100 is formed by placing fifteen inserts 10 into the bottom of a mould. A resilient material is then added to the mould and channel 104 is held at an upper region of the mould. In one example, the resilient material can be an elastomeric material, for instance a combination of a natural and synthetic rubber compounds.

Prior to being introduced into the mould, the channel 104 is cleaned and primed. Once the steel inserts and the elastomer has been positioned in the mould, the contents of the mould are then simultaneously heated and compressed for a period of time to cause the elastomeric material to cure. The lifter bar 100 is removed hot from the mould and then allowed to cool. Subsequently the lifter bar is inspected ultrasonically for voids, and excess flashing of elastomeric material is trimmed away.

As a result of the moulding process, a chemical bond is formed between the inserts 10 and the elastomeric material at the boundary 108 between these component parts. Furthermore, the hook 16 becomes mechanically engaged with the elastomeric material. The insert 10 cannot separate from the elastomeric body 102 without mechanical disruption to the lifter bar 100. This mechanical engagement with the body provides additional resistance to separation of the inserts 10 from the body 102 as a result of the high stresses put on the lifter bar 100 during use.

The hook 16 is joined to the remainder of insert 10 by way of a shank portion 18 and the hook 16 also includes a free end 20. It can be seen that the shank portion 18 is disposed closer to the mounting surface 106 than the free end 20. The reason for this is that, as the lifter bar wears away during use, material is lost from the inserts 10 as they gradually wear down. By providing the shank 18 low down within the lifter bar 100, the shank 18 is one of the last parts of the insert 10 to wear away, thus maintaining a degree of mechanical engagement between the insert 10 and elastomeric body 102 and extending the service life of the lifter bar 100.

In use, a grinding media consisting of steel balls is agitated in the grinding mill along with the material being processed. The size of the steel balls is selected according to the task at hand, but typically ranges in size from about 50 mm to 140 mm in diameter. By providing inserts with a thickness of 65 mm, this means that multiple simultaneous ball impacts across the width of the exposed face of the insert are avoided, thereby prolonging the life of these components. Achieving the narrow width of such inserts is also more convenient and cost effective when produced by a cutting technique rather than trying to use a conventional casting process to produce sufficiently thin inserts, which are prone to breakage or shattering on impact from a steel ball.

In the embodiment described above, the mill liner component was a lifter bar 100. The invention can also be applied to other mill liner component such as shell flat liner wear plates.

In the embodiment described above the insert was formed from a plate of hardened steel that was 65 mm thick. In other embodiments the inserts may be of other thicknesses and may be from 10 mm up to 100 mm thick.

In the embodiment described above the formation of the insert which mechanically engages with the body was provided in the form of a hooked portion. Similarly, other types of formation can be used to provide mechanical engagement such as formations with an "L" shaped profile, "T" shaped profile, some sharp spikes, and so on. Common to each of these shapes is that the formation can be produced by making a continuous outline of the insert and the formation in a single cutting operation with no need to stop and start the cutting instrument, and that the resulting formation cannot be pulled from the body without significant disruption to material forming the body due to an improved mechanical engagement between the insert and the material of the body.

In the embodiment described above the resilient material was formed as an elastomeric body 102, which comprised a mixture of natural and synthetic rubbers. In other embodiments, the body may be formed from another resilient material such as polyurethane, or a combination of polyurethane with other materials.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A method of fabricating a liner component for a grinding mill, the method including the steps of:

providing a plate of hard material;

cutting the plate to form a plurality of inserts, the inserts having a major dimension and opposed major surfaces in the form of planar side faces defining a thickness therebetween of from 10 mm to 100 mm, and at least some of the inserts including a formation for mechanically engaging with a body of resilient material, having a surface extending between the planar faces located adjacent the formation defining a boundary for engagement with a body of resilient material, and further having an area, located between the planar side faces of the insert, that extends beyond the boundary in a direction away from the formation, which is positioned to be unsupported by a body of resilient material;

arranging the inserts in a mould, and adding resilient material to the mould to form a resilient material body around the inserts to thereby form the liner component where the inserts are distributed along the length of the liner component and arranged so that the major dimension of each insert is oriented normal to the length of the liner component.

2. A method according to claim 1, further including the step of applying heat and pressure to the contents of the mould to cure the resilient material to thereby form the body.

3. A method according to claim 1, wherein the step of cutting the plate includes any of laser, plasma or oxy cutting.

4. A method according to claim 1, wherein the plate is formed from steel.

5. A method according to claim 1, wherein the formation includes a hooked portion.

6. A liner component for a grinding mill, comprising:

a resilient material body; and a plurality of inserts constructed from a plate of hard material, the inserts having opposed major surfaces in the form of planar side faces that are spaced from each other to define a thickness therebetween of from 10 mm to 100 mm, and each insert having a major dimension extending along each said planar side face which defines the major dimension of the insert, and at least some of the inserts of the plurality including a formation for mechanically engaging with said resilient material body, the inserts being distributed along the length of the liner component and arranged so that the major dimension of each planar side of each insert is oriented normal to the length of the liner component, wherein said at least some of the inserts including said formation are mechanically engaged with said resilient material body along a boundary, and said resilient material is formed around said plurality of inserts to thereby form the liner component, and wherein the planar side faces of adjacent inserts are spaced from one another by a region of said resilient material, and wherein each insert has an area, located between the planar side faces of the insert, that extends beyond the boundary in a direction away from the formation, and which is unsupported by the resilient material body.

7. A liner component according to claim 6, wherein the inserts are distributed along the length of the liner component at a regular pitch.

8. A liner component according to claim 7, wherein the pitch is less than 120 mm.

9. A liner component according to claim 6 wherein the inserts are of a thickness of about 65 mm.

10. A liner component according to claim 6, wherein the resilient material includes an elastomeric material.

11. A liner component according to claim 6, wherein the formation of each said insert of said plurality of inserts is integrally formed with said insert as a single piece of material.

12. A liner component according to claim 6, wherein the planar side faces of adjacent inserts that are spaced from one another by a region of said resilient material are in contact with said resilient material.

13. A liner component for a grinding mill, the component including:

a generally elongate resilient material body;

a plurality of inserts associated with the body, the inserts having opposed major surfaces in the form of planar side faces defining a thickness therebetween of from 10 mm to 100 mm, and having a major dimension extending along each planar side face of each insert which defines the major dimension of the insert, the inserts being distributed along the length of the body and being arranged so that the major dimension of each planar side face of each insert is oriented normal to the length of the liner component; and at least some of the inserts including a formation which engages mechanically with the body;

wherein the inserts have a measured Charpy v-notch test toughness of more than 10 Joules at −40 C.;

wherein the planar side faces of adjacent inserts are spaced from one another by a region of said resilient material, and wherein each insert has an area, located between the planar side faces of the insert, that extends away from a boundary which is defined between the insert and the resilient material body, the area being located in a direction away from the formation and being unsupported by the resilient material body.

14. A liner component according to claim 13, wherein the inserts have a measured Charpy v-notch test toughness of between 10 Joules and 45 Joules.

15. A liner component according to claim 13, wherein the formation of each said insert of said plurality of inserts is integrally formed with said insert as a single piece of material.

* * * * *